US005376520A

United States Patent [19]

Kita et al.

[11] Patent Number: 5,376,520

[45] Date of Patent: Dec. 27, 1994

[54] SILVER HALIDE LIGHT SENSITIVE COLOR PHOTOGRAPHIC MATERIAL

[75] Inventors: Hiroshi Kita; Hirokazu Sato, both of Hino, Japan

[73] Assignee: Konica Corporation, Japan

[21] Appl. No.: 161,147

[22] Filed: Dec. 2, 1993

[30] Foreign Application Priority Data

Dec. 7, 1992 [JP] Japan ..... 4-326826

[51] Int. Cl.[5] ..... G03C 7/388

[52] U.S. Cl. ..... 430/546; 430/551

[58] Field of Search ..... 430/546, 551

[56] References Cited

U.S. PATENT DOCUMENTS

| | | | |
|---|---|---|---|
| 3,860,425 | 1/1975 | Ono et al. | 430/546 |
| 4,713,317 | 12/1987 | Nakamura et al. | 430/551 |
| 4,970,139 | 11/1990 | Bagchi | 430/546 |

FOREIGN PATENT DOCUMENTS

| | | | |
|---|---|---|---|
| 0019800 | 12/1980 | European Pat. Off. | 430/551 |
| 2151849 | 7/1987 | Japan | 430/546 |

*Primary Examiner*—Lee C. Wright

*Attorney, Agent, or Firm*—Jordan B. Bierman

[57] ABSTRACT

A silver halide color photographic light-sensitive material containing a polyvalent alcohol is disclosed. The polyvalent alcohol has two or more hydroxy group and is water immissible. The polyvalent alcohol is used in combination with a dye forming coupler.

13 Claims, No Drawings

SILVER HALIDE LIGHT SENSITIVE COLOR PHOTOGRAPHIC MATERIAL

FIELD OF THE INVENTION

The present invention relates to a silver halide color photographic light-sensitive material, and more particularly, to a silver halide color photographic light-sensitive material excellent in light-fastness for color images thereon and further excellent in coloring property.

BACKGROUND OF THE INVENTION

In the field of a silver halide color photographic light-sensitive material, it is requested that dye images obtained from a coupler are stable against color changing and color fading even when they are exposed to light for a long time or stored under high temperature and high humidity conditions.

However, it is known that the above-mentioned dye images do not have sufficient stability mainly against UV rays or visible rays so that they are subject to color change and color fading when they are exposed to the above-mentioned actinic rays. In order to dissolve the above-mentioned problems, there have been proposed methods including one to choose various couplers with a property of less color fading property, one to use a UV absorber for protecting dye images from UV rays or one to introduce to a coupler a group providing light flatness.

However, in order to provide satisfactory light fastness to dye images by the use of a UV absorber, it is necessary to use UV absorbers in a relatively large amount. In such occasions, dye images were sometimes noticeably contaminated due to coloring of the UV absorber itself. In addition, a UV absorber does not work to prevent color fading of dye images caused by visible rays. In other words, there is a limitation in improving light fastness by a UV absorber.

In addition, methods to use a phenol hydroxyl group or an agents for preventing dye image fading having a group which generates, through hydrolysis, a phenol hydroxyl group are known. For example, Japanese Patent Publication Nos. 31256/1973, 31625/1973 and 30462/1976 and Japanese Patent Publication Open to Public Inspection (hereinafter referred to as Japanese Patent O.P.I. Publication) Nos. 134326/1974 and 134327/1974 propose methods to use a phenols and a bisphenols. U.S. Pat. No. 3,069,262 proposes a method to use pyrogallol and garlic acid and its esters, U.S. Pat. Nos. 2,360,290 and 4,015,990 propose methods to use a-tocopherols and its acyl derivatives, Japanese Patent Publication No. 27534/1977, Japanese Patent O.P.I. Publication No. 14751/1977, and U.S. Pat. No. 2,735,765 propose methods to use hydroquinone derivatives, U.S. Pat. Nos. 3,432,300 and 3,574,627 propose methods to use 6-hydroxychromans, U.S. Pat. No. 3,573,050 proposes a method to use 5-hydroxychroman derivatives and Japanese Patent Publication No. 20977/1974 proposes a method to use 6,6'-dihydroxy-2,2'-spirobichromans. However, the above-mentioned compounds do not show sufficient effects for preventing color fading or color changing of dyes, though they show the effects to some extent.

British Patent No. 1,451,000 discloses a method to improve stability of dye images against light by the use of azomethine extinction compounds whose absorption peak is more bathochromic compared with the peak of dye images. However, their influence on the hue of dye images is so noticeable and disadvantageous, because the azomethine extinction compounds themselves are colored.

Methods to stabilize dyes against light by the use of metal complexes are disclosed in Japanese Patent O.P.I. Publication No. 87649/1975 and Research Disclosure No. 15162 (1976). However, an amount capable of providing enough effects for preventing color fading cannot be added since these complexes have neither sufficient effects for preventing color fading nor high solubility on organic solvents. In addition, these complexes themselves are noticeably colored, so that they adversely affect the hue and purity of the dye images formed through color development processing, when a large amount of them are added.

SUMMARY OF THE INVENTION

The first object of the present invention is to provide a silver halide color photographic light-sensitive material wherein the spectral absorption characteristics of dye images formed therein is excellent and light fastness of the dye images has noticeably been improved.

The second object of the present invention is to provide a silver halide color photographic light-sensitive material excellent in coloring property.

The silver halide color photographic light-sensitive material of the invention contains a polyvalent alcohol represented by the Formula I $$\text{I}\quad R_1—O—R_2$$

wherein $R_1$ represents an alkyl, alkenyl, cycloalkyl or cycloalkenyl group, $R_2$ represents an alkyl, alkenyl, cycloalkyl, cycloalkenyl, —C(=)—$R_3$, —SO—$R_4$, —(O=)P<($OR_5$)($OR_6$), —(O=)P<($R_7$)($R_8$), —C(O)—N<($R_9$)($R_{10}$) or —$SO_2$N<($R_{11}$)($R_{12}$), where $R_3$ to $R_9$ and $R_{11}$ each represent an alkyl, alkenyl, cycloalkyl, cycloalkenyl, or aryl group, $R_{10}$ and $R_{12}$ each represent a hydrogen atom, alkyl, alkenyl, cycloalkyl, cycloalkenyl, or aryl group, provided that, when $R_1$ to $R_{12}$ are other than hydrogen or aryl, at least one carbon atom of the alkyl, alkenyl, cyloalkyl, and/or cycloalkenyl groups is substituted with hydroxy group and number of alcoholic hydrocarbon in a molecule is two or more, and $R_1$ and $R_2$ may form a ring by condensing each other.

The polyvalent alcohol is preferably represented by either of the above-mentioned Formulas II through Formula V.

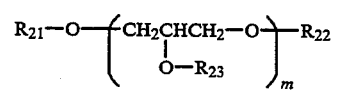

II wherein $R_{21}$, $R_{22}$ and $R_{23}$ each represent a hydrogen atom, alkyl, alkenyl, cycloalkyl, cycloalkenyl, acyl, sulfonyl, phosphonyl, carbamoyl or sulfamoyl group, m is an integer of 1 to 20. When m is two or more, two or more of $R_{23}$ may be same or different. Preferably m is 2. When m is 1, two of $R_{21}$, $R_{22}$ and $R_{23}$ are hydrogen atom. When m is two or more, at least two of $R_{21}$, $R_{22}$ and $R_{23}$ are hydrogen atom but all of $R_{21}$, $R_{22}$ and $R_{23}$ are not a hydrogen atom simultaneously. Preferably two or more of $R_{21}$, $R_{22}$ and $R_{23}$ are hydrogen atom and the others are acyl group.

III

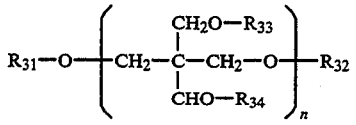

wherein $R_{31}$, $R_{32}$, $R_{33}$ and $R_{34}$ each represent a hydrogen atom, an alkyl, alkenyl, cycloalkyl, cycloalkenyl, acyl, sulfonyl, phosphonyl, carbamoyl or sulfamoyl group, n is an integer of 1 to 20. When 2 is two or more, two or more of $R_{33}$ or $R_{34}$ may be same or different. When n is 1, at least two of $R_{31}$, $R_{32}$, $R_{33}$ and $R_{34}$ are hydrogen atom. When n is two or more, at least two of $R_{31}$, $R_{32}$, $R_{33}$ and $R_{34}$ are hydrogen atom but all of $R_{31}$, $R_{32}$, $R_{33}$ and $R_{34}$ are not a hydrogen atom simultaneously.

IV

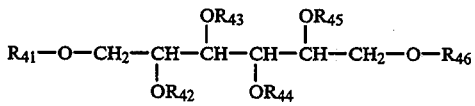

wherein $R_{41}$ to $R_{46}$ each represent a hydrogen atom, an alkyl, alkenyl, cycloalkyl, cycloalkenyl, acyl, sulfonyl, phosphonyl, carbamoyl or sulfamoyl group, and at least two of $R_{41}$, $R_{42}$, $R_{43}$, $R_{44}$, $R_{45}$ and $R_{46}$ are hydrogen atom but all of $R_{41}$ to $R_{46}$ are not a hydrogen atom simultaneously.

V

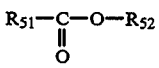

wherein $R_{51}$ is a substituted alkyl or substituted alkenyl group each of which has two or more hydroxy groups, $R_{52}$ is an alkyl, alkenyl, cycloalkyl or cycloalkenyl group, and $R_{51}$ and $R_{52}$ may form a lacton ring by condensation each other.

In the silver halide color photographic light-sensitive material of the invention, the poly valent alcohol represented by Formula I is contained in a lipophilic fine grain containing a dye forming coupler at the ratio by weight of not less than 50% to the dye forming coupler.

Another preferable embodiment of the silver halide color photographic light-sensitive material of the invention contains a poly valent alcohol represented by the above-mentioned Formula VI or VII

VI

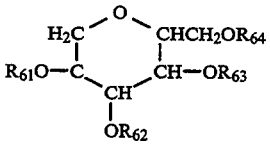

VII

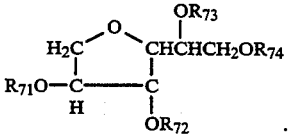

In the formulae, $R_{61}$, $R_{62}$, $R_{63}$, $R_{64}$, $R_{71}$, $R_{72}$, $R_{73}$ and $R_{74}$ each represent a hydrogen atom, an alkyl, alkenyl, cycloalkyl, cycloalkenyl, aryl, acyl, sulfonly, phosphonyl, carbamoyl or sulfamoyl group, and at least two of $R_{61}$, $R_{62}$, $R_{63}$, $R_{64}$, $R_{71}$, $R_{72}$, $R_{73}$ and $R_{74}$ are hydrogen atom but all of $R_{61}$ to $R_{64}$ and $R_{71}$ to $R_{74}$ are not a hydrogen atom simultaneously. Preferably two or more of $R_{61}$, $R_{62}$, $R_{63}$, $R_{64}$, $R_{71}$, $R_{72}$, $R_{73}$ and $R_{74}$ are hydrogen atom and the others are acyl group.

The poly valent alcohol represented by Formula VI is contained in a lipophilic fine grain containing a dye image forming coupler at the ratio by weight of not less than 50% to the dye forming coupler.

DETAILED DISCLOSURE OF THE INVENTION

The present invention will be explained in detail.

Poly valent alcohol compounds represented by Formulas I through VIII of the present invention will be explained.

In Formulas I through V, alkyl groups represented by $R_1$, $R_2$, $R_3$, $R_4$, $R_5$, $R_6$, $R_7$, $R_8$, $R_9$, $R_{10}$, $R_{11}$, $R_{12}$, $R_{21}$, $R_{22}$, $R_{23}$, $R_{31}$, $R_{32}$, $R_{33}$, $R_{34}$, $R_{41}$, $R_{42}$, $R_{43}$, $R_{44}$, $R_{45}$, $R_{46}$, $R_{61}$, $R_{62}$, $R_{63}$, $R_{64}$, $R_{71}$, $R_{72}$, $R_{73}$ and $R_{74}$ hereinafter (abbreviated as $R_1$ through $R_{74}$) may be either straight-chained or branched-chained. Of them, those having 1 to 32 carbons are preferable. For example, a methyl group, an ethyl group, an isopropyl group, a t-butyl group, a dodecyl group, a heptadecyl group and a 2-ethylhexyl group are typically cited.

Alkenyl groups represented by $R_1$ through $R_{83}$ may be either straight-chained or branched-chained. Of them, those having 2 to 32 carbons are preferable. For example, a vinyl group, a propenyl group, a 11-undecenyl group and a 1-methylpropenyl group are typically cited.

As a cycloalkyl group represented by $R_1$ through $R_{83}$, those having 3 to 12 carbons are preferable, and those having 5 to 7 carbons are especially preferable. They may have a branch-structure. For example, a cyclohexyl group, a cyclopentyl group, a cyclopropyl group and a 2-methylcyclopropyl group are typically cited.

As a cycloalkenyl group represented by $R_1$ through $R_{74}$, those having 3 to 12 carbons are preferable, and those having 5 to 7 carbons are especially preferable. They may have a branch-structure. For example, a 1-cyclohexyenyl group and a 2-cyclopentenyl group are typically cited.

As an aryl group represented by $R_3$, $R_4$, $R_5$, $R_6$, $R_7$, $R_8$, $R_9$, $R_{10}$, $R_{11}$, $R_{12}$, $R_{61}$, $R_{62}$, $R_{63}$, $R_{64}$, $R_{71}$, $R_{72}$, $R_{73}$, $R_{74}$, those having 6 to 14 carbons are preferable. A phenyl group, a 1-naphtyl group and a 2-naphtyl group are typically cited.

In addition, the above-mentioned alkyl group, alkenyl group, cycloalkyl group, cycloalkenyl group and aryl group may be substituted with a substituent. As the substituent therefor, an alkyl group, an alkenyl group, a cycloalkenyl group, an alkinyl group, an aryl group, a heterocycle group, an alkyl thio group, an aryl thio group, a heterocyclic thio group, a sulfonyl group, a sulfinyl group, an acyl group, a carbamoyl group, a sulfamoyl group, a cyano group, an alkoxy group, an aryloxy group, a heterocyclic oxy group, a siloxy group, an acyloxy group, a carbamoyloxy group, an amino group, an alkyl amino group, an anilino group, an acyl amino group, a sulfonamide group, an imide group, an ureido group, a sulfamoyl amino group, an alkoxycarbonyl amino group, an aryloxycarbonyl amino group, an alkoxycarbonyl group and an aryloxycarbonyl group, a spiro compound residual group, a bridged hydrocarbon residual group, a halogen atom and a hydroxyl group are cited.

A substituted alkyl group or a substituted alkenyl group each containing 2 or more hydroxyl groups represented by $R_{51}$ represent an alkyl group and an alkenyl group (each including those substituted by a substituent) represented by the above-mentioned $R_1$ through $R_{52}$ wherein 2 or more arbitrary hydrogen atoms are substituted by a hydroxyl group. A 1,2-dihydroxypropyl group and a 1,1-dihydroxymethylethyl group are typically cited.

As an acyl group represented by $R_{21}$, $R_{22}$, $R_{23}$, $R_{31}$, $R_{32}$, $R_{33}$, $R_{34}$, $R_{41}$, $R_{42}$, $R_{43}$, $R_{44}$, $R_{45}$, $R_{46}$, $R_{61}$, $R_{62}$, $R_{63}$, $R_{64}$, $R_{71}$, $R_{72}$, $R_{73}$ and $R_{74}$ (hereinafter abbreviated as $R_{21}$ to $R_{74}$) and Y, —C(=O)—$R_3$ ($R_3$ represents the above-mentioned compounds) is preferable;

The sulfonyl group represented by $R_{21}$ through $R_{74}$, is preferably —$SO_2$—$R_4$ ($R_4$ represents the above-mentioned compounds);

The preferable example of phosphonyl group represented by $R_{21}$ through $R_{74}$, is —(O=)P<($OR_5$)($OR_6$) ($R_5$ and $R_6$ represent the above-mentioned compounds);

The preferable example of the carbamoyl group represented by $R_{21}$ through $R_{74}$, $R_{81}$, $R_{82}$, $R_{83}$ and Y, is —C(=O)—N<($R_9$)($R_{10}$) ($R_9$ and $R_{10}$ represent the above-mentioned compounds); and The preferable example of the sulfamoyl group represented by $R_{21}$ through $R_{74}$ and Y, is —$SO_2$-N<($R_{11}$)($R_{12}$) ($R_{11}$ and $R_{12}$ represent the above-mentioned compounds).

In Formula I, $R_1$ and $R_2$ may form a ring respectively through condensation each other, $R_5$ and $R_6$, $R_7$ and $R_8$, $R_9$ and $R_{10}$ and $R_{11}$ and $R_{12}$ may be condensed each other to form a ring.

In Formula II, arbitrary two substituents of $R_{21}$, $R_{22}$ and $R_{23}$ (when m is 2 or more, each of them are regarded as an independent substituent), may be condensed each other to form a ring.

In Formula III, arbitrary two substituents of $R_{31}$, $R_{32}$ and $R_{33}$ (when n is 2 or more, plural $R_{33}$ and plural $R_{34}$ are respectively regarded as an independent substituent), may be condensed each other for forming a ring.

In Formula IV, arbitrary two substituents of $R_{41}$, $R_{42}$, $R_{43}$, $R_{44}$, $R_{45}$ and $R_{46}$ may be condensed each other to form a ring.

In Formulas VI and VII, $R_{61}$ and $R_{62}$ and/or $R_{62}$ and $R_{63}$ and/or $R_{63}$ and/or $R_{64}$ are respectively condensed each other to form a ring.

An alkylene group represented by L may be of straight-chained and branched-chained. For example, an ethylene group, a 1-methylethyl group and a propylene group are cited.

As an arylene group represented by L, a p-phenylene group, an o-phenylene group and a 1,4-naphtylene group are exemplified. An alkylene group and an arylene group represented by L may be substituted with other substituent which is the same as the substituent in the above-mentioned $R_1$ through $R_3$.

The total number of carbons in the polyvalent alcohol of the present invention is preferably not less than 6 (provided that, it is not less than 10 for Formulas VI and VII). The compound is immiscible in water.

Ployvalent alcohol of the present invention having molecular weight of not more than 5,000 is preferable, and those in the state of liquid at room temperature.

Number of hydroxy group of the polyvalent alcohol is preferably three or more. The more the number of the hydroxy group becomes, the more preferable result is obtained.

Molecular weight of the polyhydric alcohol of the present invention is preferably not more than 5000 and one which is in the liquid state at the normal temperature is preferable.

In the polyhydric alcohol of the present invention, the hydroxyl group value is preferably 50 or more.

Further, logP value of the polyhydric alcohol of the present invention preferably not less than 3.

Typical examples of the polyhydric alcohol preferably used in the present invention are given below.

II-1

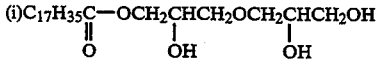

II-2

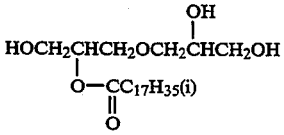

II-3

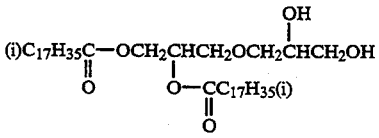

II-4

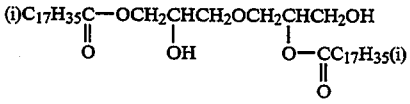

II-5

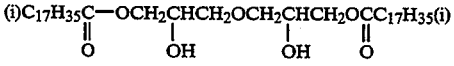

-continued
II-6
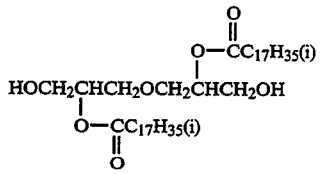
II-7
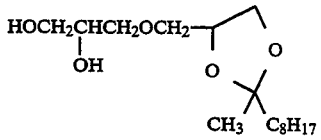
II-8
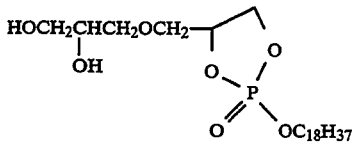
II-9
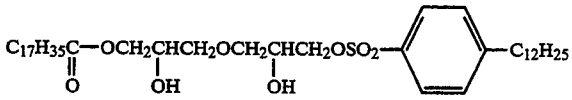
II-10
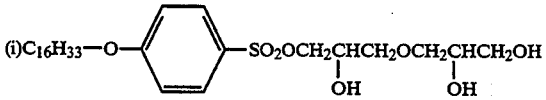
II-11
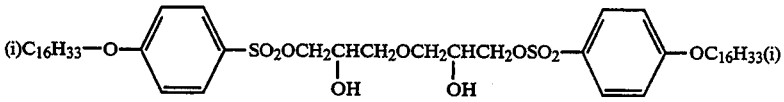
II-12
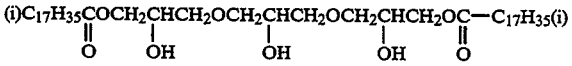
II-13
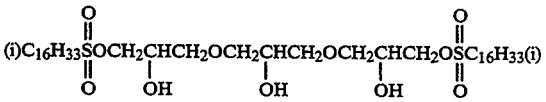
II-14
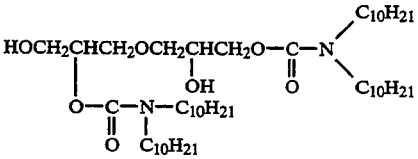
II-15
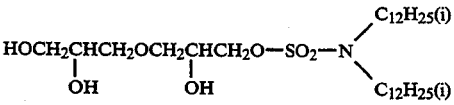
II-16
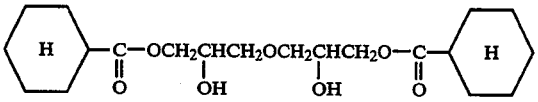

-continued
II-17
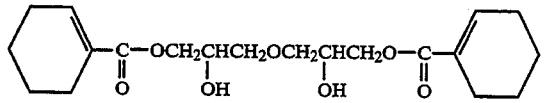
II-18
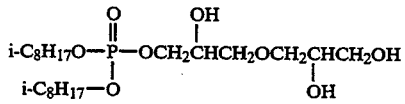
II-19 Decaglyceryltristealate
II-20 Decaglycerylpentaoleate
II-21 Decaglycerylheptaisostealate
II-22 Hexaglyceryltristealate
II-23 Hexaglycerylmonooleate
II-24 Tetraglyceryltristealate
II-25 Tetraglycerylmonooleate
II-26 $C_8H_{17}CH{=}CH(CH_2)_7COO{-}CH_2CH(OH){-}CH_2OH$
II-27 $(i)C_{17}H_{35}COO{-}CH{<}(CH_2OH)_2$
III-1
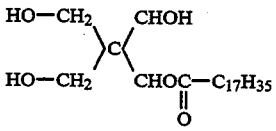
III-2
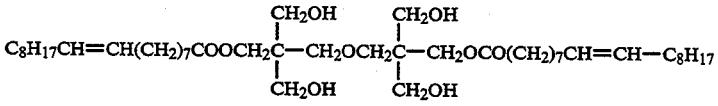
III-3
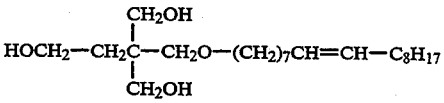
III-4
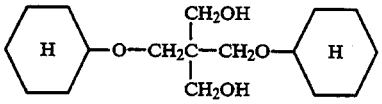
III-5
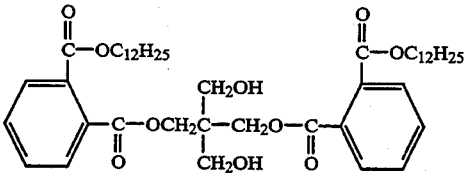
III-6
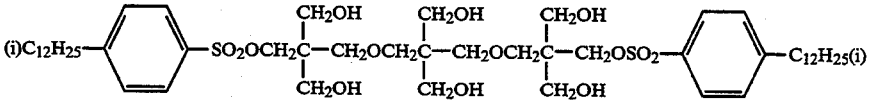
III-7

-continued
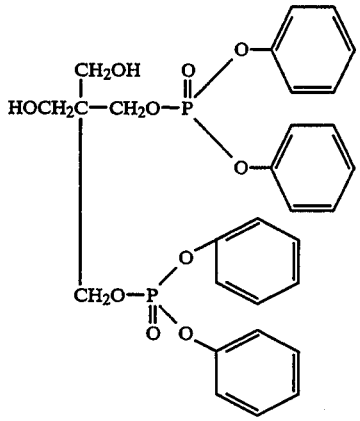
III-8
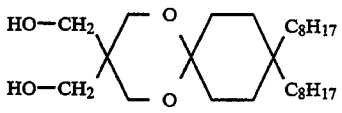
III-9
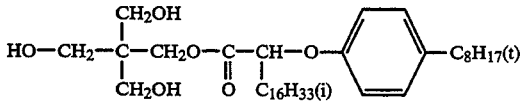
III-10
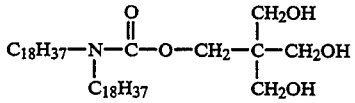
III-11
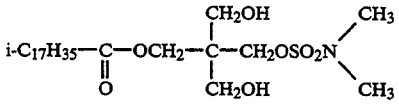
III-12
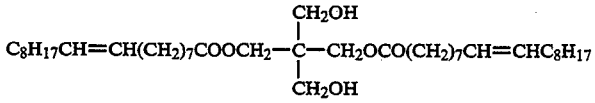
IV-1
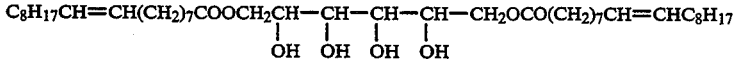
IV-2
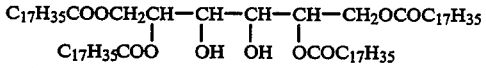
IV-3
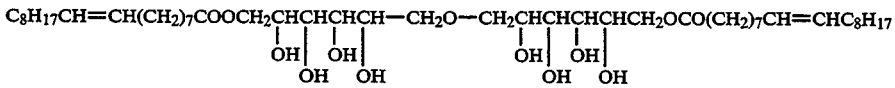
IV-4
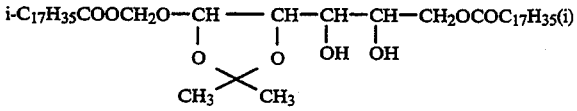
IV-5

-continued
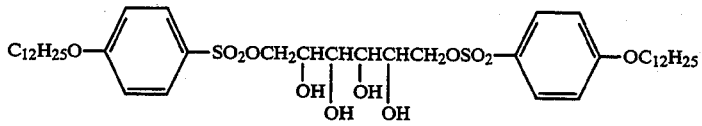
IV-6
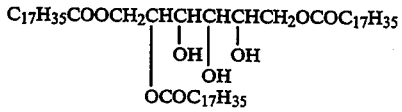
IV-7
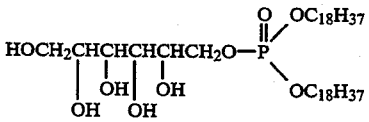
V-1
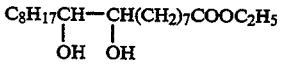
V-2
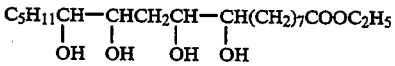
V-3
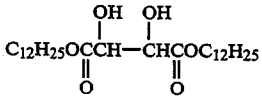
V-4
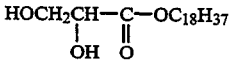
V-5
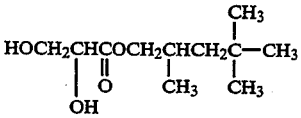
V-6
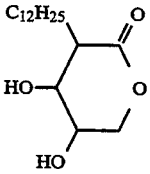
V-7
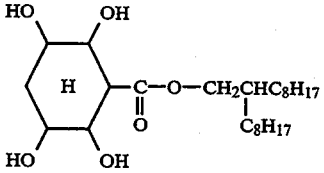
V-8
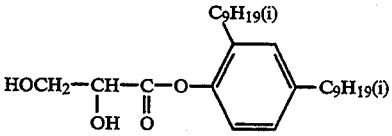
V-9

-continued
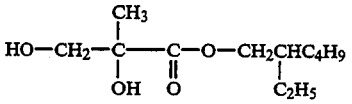
V-10
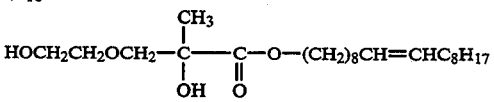
V-11
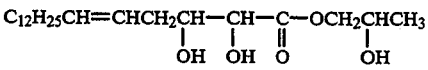
V-12
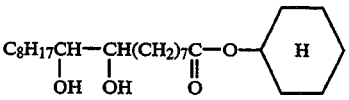
V-13
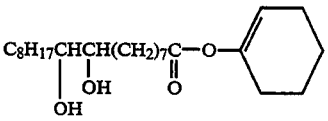
V-14
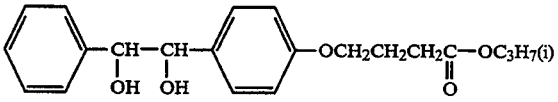
V-15
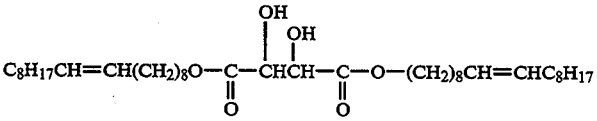
VI-1
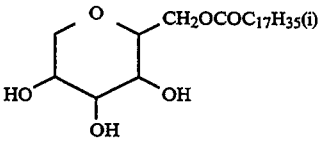
VI-2
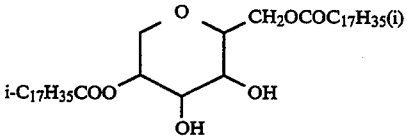
VI-3
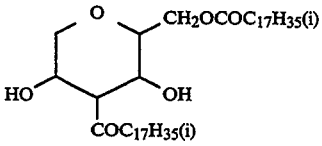
VI-4
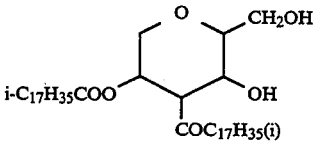
VI-5

-continued
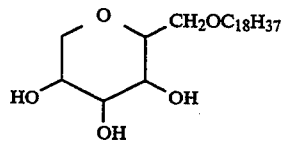
VI-6
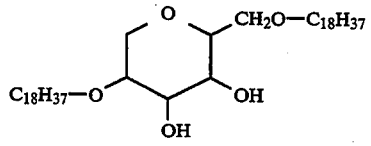
VI-7
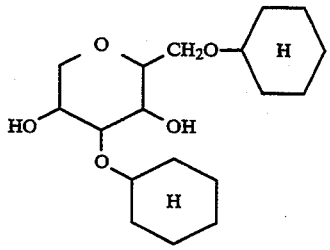
VI-8
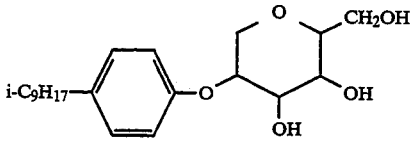
VI-9
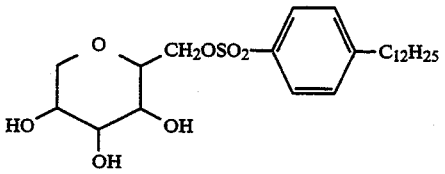
VI-10
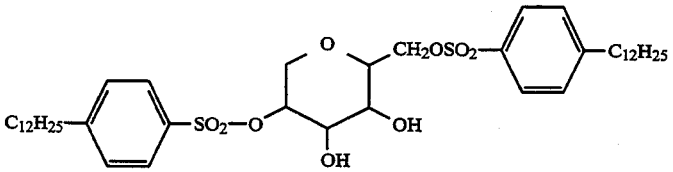
VI-11
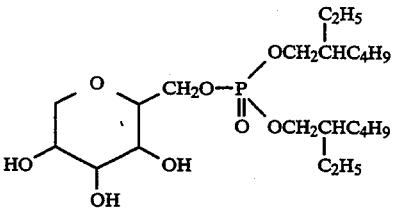
VI-12
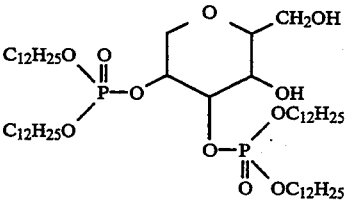

-continued
VI-13
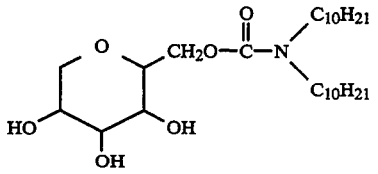
VI-14
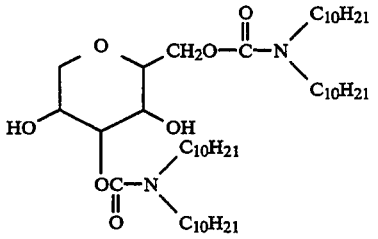
VI-15
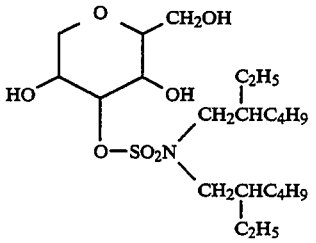
VI-16
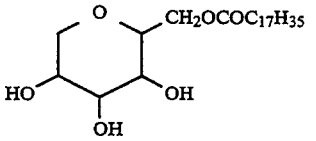
VI-17
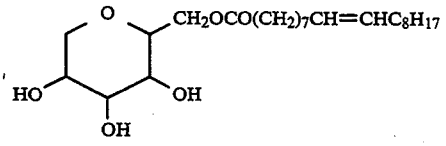
VI-18
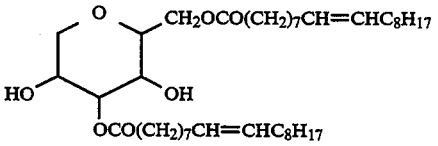
VII-1
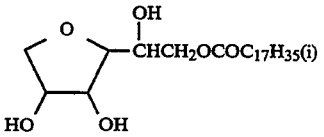
VII-2
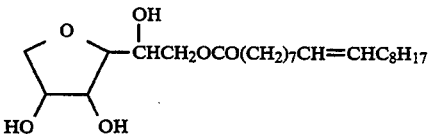
VII-3

-continued
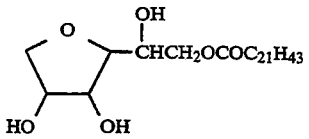
VII-4
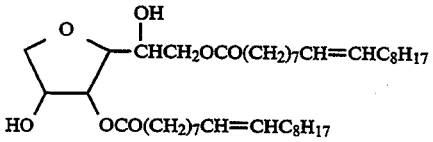
VII-5
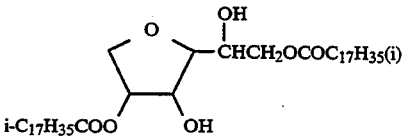
VII-6
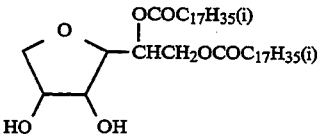
VII-7
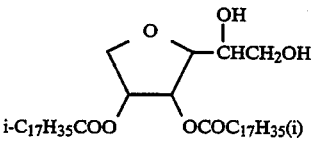
VII-8
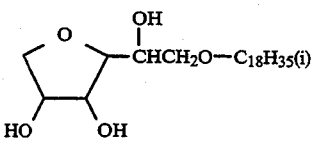
VII-9
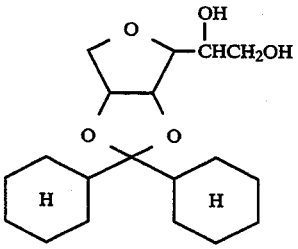
VII-10
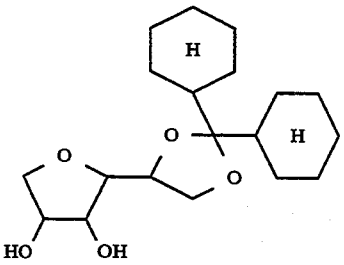
VII-11

-continued

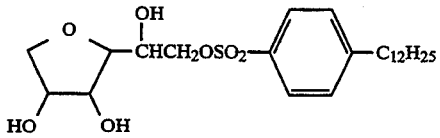

VII-12

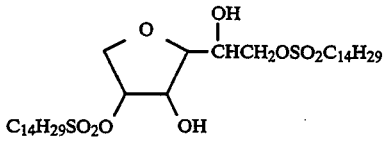

VII-13

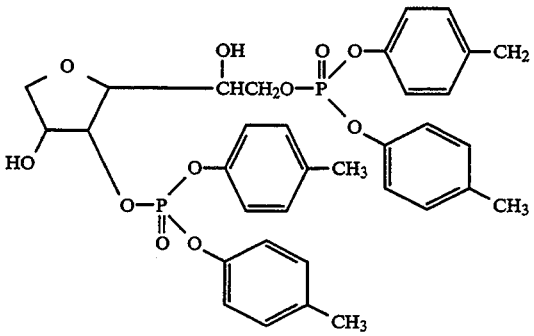

VII-14

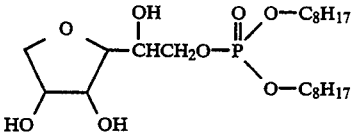

VII-15

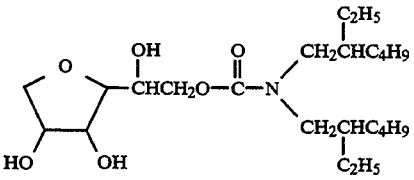

VII-16

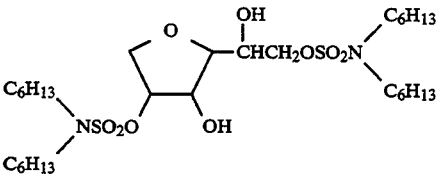

The aliphatic polyhydric alcohol of the present invention is suitably used as a solvent of a dye forming coupler to form a fine oil particle containing a dye forming coupler.

Preferable examples of yellow couplers used with the polyhydric alcohol include benzoyl acetoanilide and pyvaloyl acetoanilide coupler. Examples of magenta coupler include 5-pyrazolone, pyrazolotriazole and indazolon coupler, and examples of cyan coupler includes phenol, naphthol, pyrazoloquinazolone, pyrazolopyrimidine, pyrazolotriazole and imidazole coupler.

Preferable examples of cyan couplers used with the polyhydric alcohol include C-1 to C-24 cited in pp 59 to 61 JA OPI 4-313751.

M-1
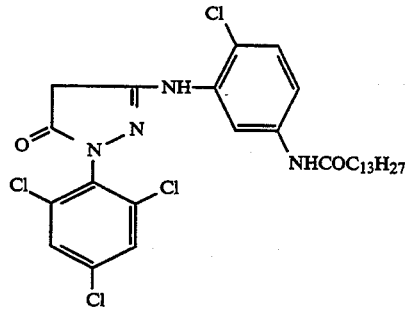
M-2
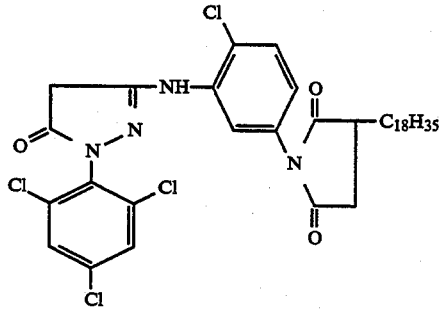
M-3
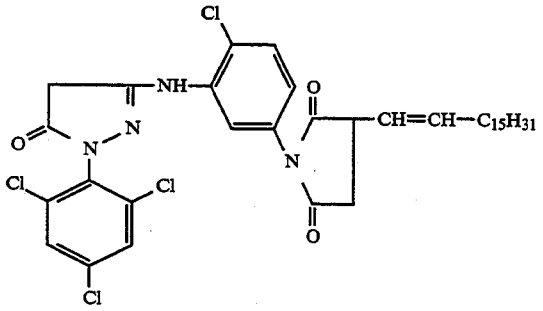
M-4
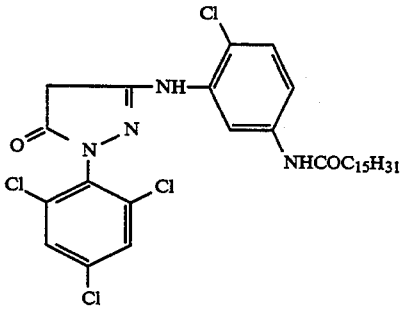
M-5
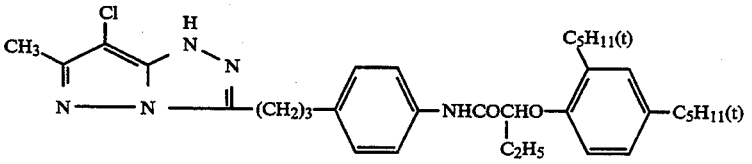
M-6
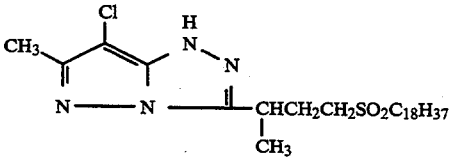

-continued
M-7
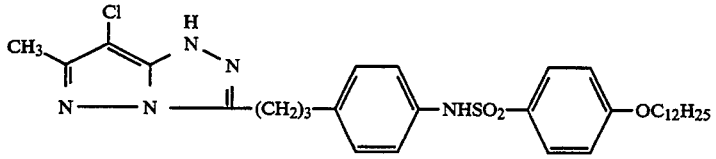
M-8
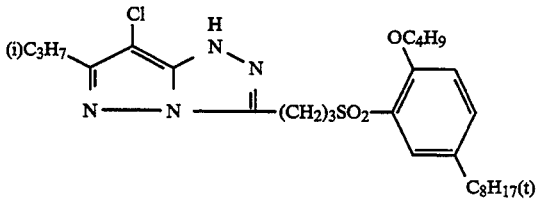
M-9
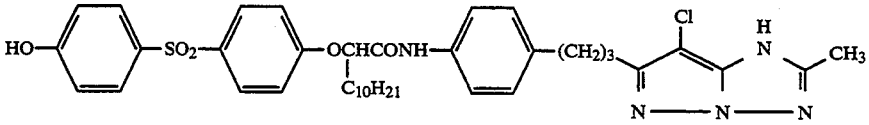
M-10
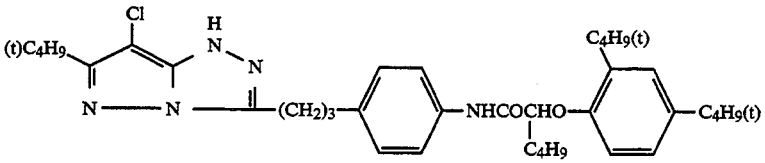
M-11
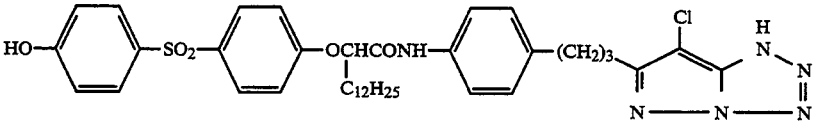
M-12
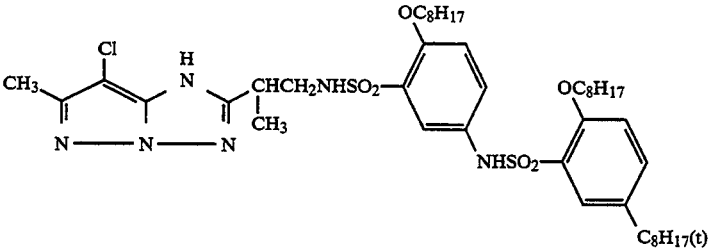
M-13
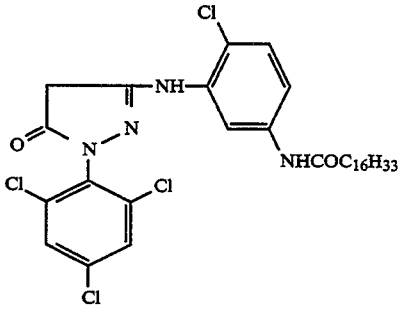

-continued
M-14
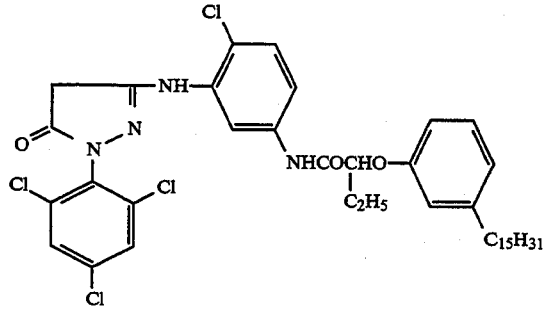
M-15
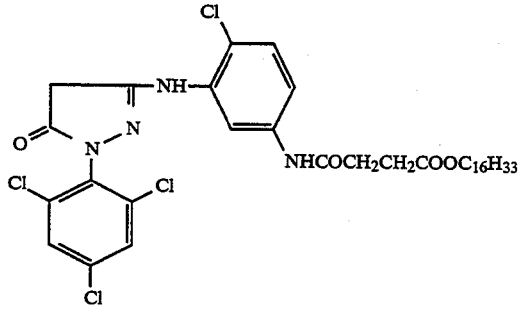
M-16
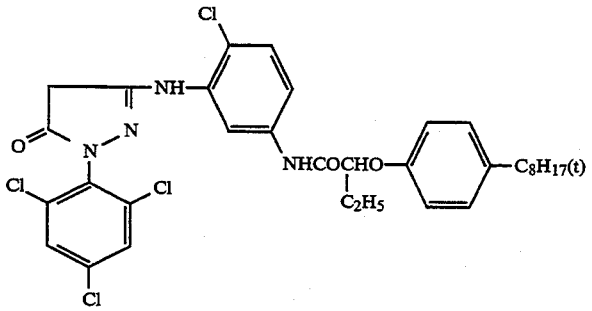
M-17
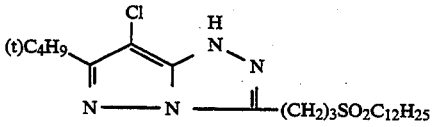
M-18
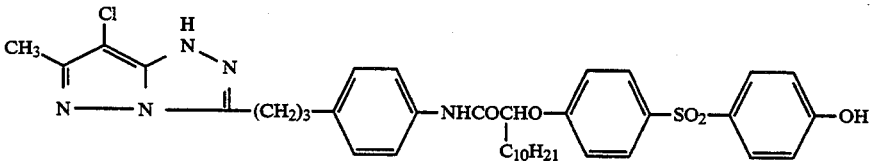
M-19
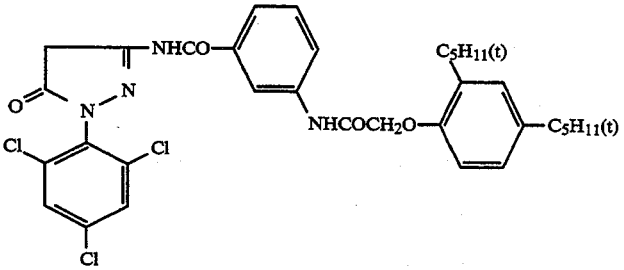

-continued
M-20
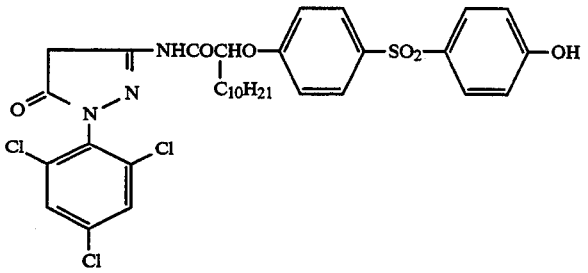
M-21
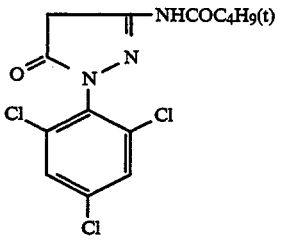
M-22
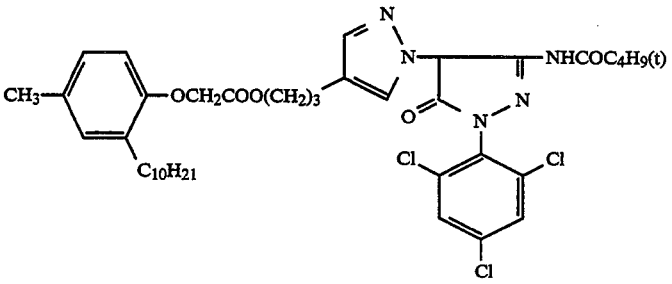
M-23
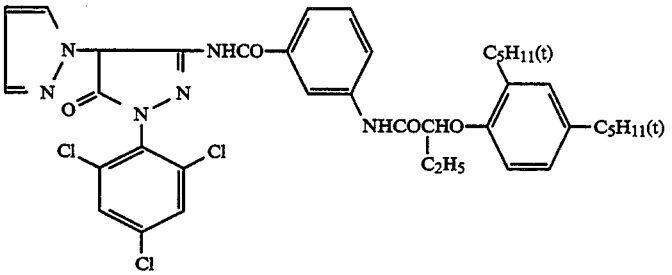
M-24
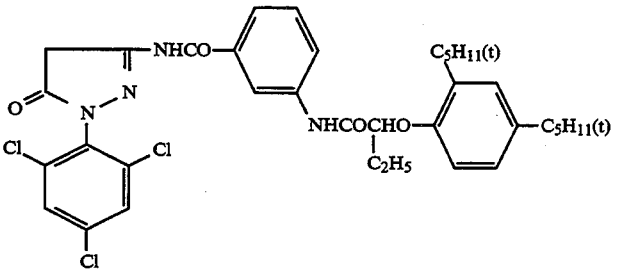
M-25
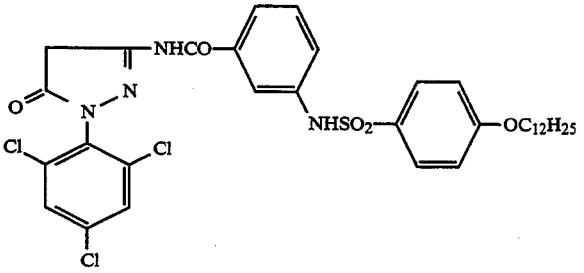

-continued
M-26
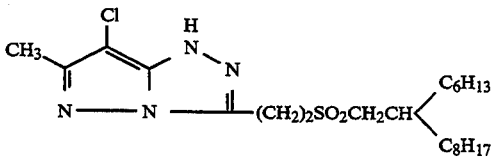
M-27
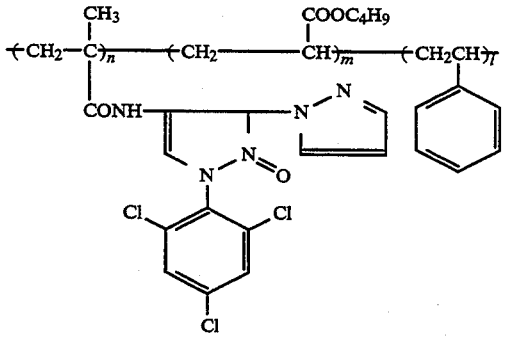
n/m/l = 50/25/25 (weight %)
Weight average molecular weight ≈ 30,000
M-28
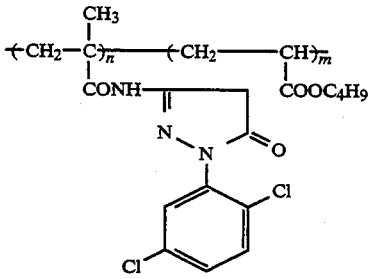
n/m = 50/50 (weight %)
M-29
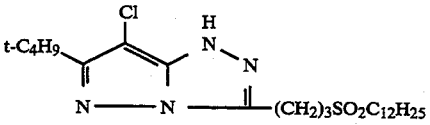
M-30
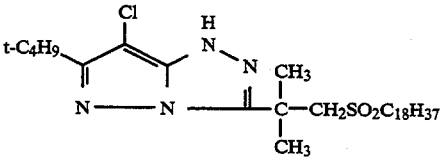
M-31
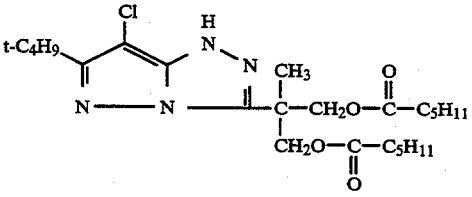
M-32
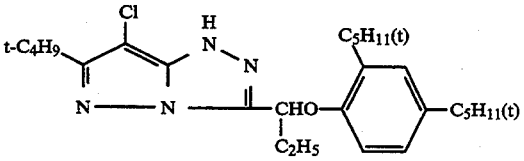

-continued

M-33

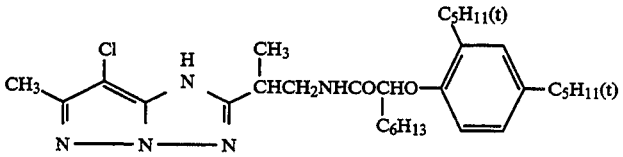

Magenta coupler is most preferable to use in combination with the polyhydric alcohol compound of the invention. Preferable examples of the magenta coupler is represented by

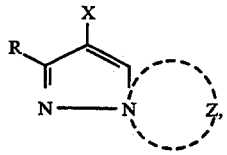

wherein Z is a group of non-metal atoms necessary to complete a nitrogen-containing heterocyclic ring which may have a substituent; X represents a hydrogen atom or a group which is capable of being released upon reaction with an oxidation product of a color developing agent; and R represents a hydrogen atom or a substituent.

The coupler can usually be used at the amount between $1\times10^{-3}$ mols and 1 mol per a mol of silver halide and, more preferably within a range between $1\times10^{-2}$ mol and $8\times10^{-1}$ mols.

In the present invention, a dye forming coupler and the aliphatic polyhydric alcohol, which is referred to as "polyhydric alcohol", are usually incorporated in at least one of the silver halide emulsion layer.

In order to incorporate the dye-forming coupler and the polyhydric alcohol in the silver halide emulsion layer, the coupler and the polyhydric alcohol are, individually or in combination, dissolved in a mixture of high boiling solvent such as dibutylphthalate, tricredylphosphate and so on and a low boiling solvent such as butyl acetate, ethylacetate and so on, or in a low boiling solvent cited above, they are mixed with gelatin solution containing surfactant, then the mixture is emulsified by high speed mixer, colloid mill or hypersonic dispersing machine. The resulting emulsion is added directly to the silver halide emulsion. After the above-mentioned emulsification solution is set, finely divided and after washing, this be added to the emulsion.

In the present invention, the emulsion containing the magenta coupler or the polyhydric alcohol are prepared and added to the silver halide emulsion separately, however, in accordance with the preferable embodiment of the present invention, both the magenta coupler and the polyhydric alcohol are dissolved, dispersed and incorporated in the silver halide emulsion simultaneously.

The polyhydric alcohol is used in an amount of 0.01 to 20 g, prefably 0.5 to 8 g per 1 g of the coupler. The polyhydric alcohol of the present invention may be used either singly or two or more kinds in combination. Weight ratio of the polyhydric alcohol to coupler is preferably more than 50%.

As for the silver halide emulsion used for the light-sensitive color photographic material of the present invention, any conventionally known silver halide emulsion can be used. Said emulsion can be sensitized either chemically or optically in a desired wavelength region by the conventional method and using an appropriate sensitizing dye.

To the silver halide emulsion, any conventionally known photographic additives such as an anti-foggant, a stabilizing agent, etc. can be added. As the binder used in the silver halide emulsion, gelatin is advantageous.

Other emulsion layer and hydrophilic colloidal layer can be hardened and can comprise a plasticizer or a dispersion of water-insoluble synthetic coupler is used in the emulsion layer of the color photographic light-sensitive material.

The light-sensitive material can comprise a colored coupler and competing coupler having color correction ability, a compound releasing such a photographically usable fragment, on reaction with an oxidation product of developing agent, as developing accelerating agent, toning agent, hardener, fogging agent, antifogging agent, chemical sensitizer, optical sensitizer or desensitizer.

The light-sensitive material can comprise one or more auxiliary layers such as a filter layer, an anti-halation layer, an anti-irradiation layer, etc. These auxiliary layers and/or the silver halide emulsion layer can comprise a dye which is capable of dissolving out from the light-sensitive material or is bleached during photographic processing. Further in the light-sensitive material, other photographic additives such as formalin scavenger, fluorescent brightening agent, matting agent, lubricant, image stabilizing agent, surfactant, anti color-foggant, development accelerator, development retarder, bleaching accelerator, etc. may also be incorporated.

As for the support, a paper laminated with polyethylene, etc., polyethylene terephthalate film, baryta paper, cellulosetriacetate film, etc. can be used.

To obtain a dye image by using the light-sensitive material of the present invention, conventional color photographic processes which are known and used in the art can be applied after imagewise exposure.

Further in the green sensitive silver halide emulsion layer comprising the dye-forming coupler of the present invention, it is preferable that at least one of dye image stabilizing agent represented by formula AO-I or AO-II is incorporated.

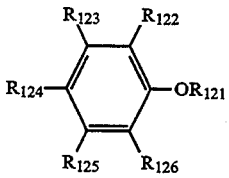

AO-I

In the formula $R_{121}$ represents a hydrogen atom, an alkyl group, an aryl group, a heterocyclic group or a residue represented below:

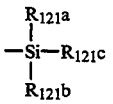

In the formula, $R_{121}a$, $R_{121}b$, and $R_{121}c$ individually represent a mono-valent organic group; $R_{122}$, $R_{123}$, $R_{124}$, $R_{125}$, and $R_{126}$ independently represent a hydrogen atom, a halogen atom or a group which is capable of substituting to the benzene ring; and $R_{121}$ through $R_{126}$ may individually be connected with each other to form bond each other and form a 5-membered or a 6-membered cyclic group.

AO-II

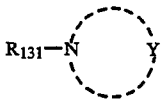

In the formula $R_{131}$ represents an aliphatic group or an aromatic group and Y represents a group of non-metal atoms necessary to complete a 5- to 7-membered ring together with a nitrogen atom.

As for the alkyl group and aryl group the heterocyclic group represented by $R_{121}$ in formula AO-I, those listed for $R_3$ in the formulas I to V may be mentioned and as for the heterocyclic group, for example, pyrazole group, 2-imidazolyl group, 3-pyridyl group and 2-furyl group are listed. As for the mono-valent organic group which $R_{121}a$, $R_{121}b$, and $R_{121}c$ represent, an alkyl group, an aryl group, an alkoxy group, an aryloxy group, a halogen atom, etc. may be mentioned. As for $R_{121}$, a hydrogen atom or an alkyl group is preferable. As for the group which is capable of being a substituent to the benzene ring, represented by $R_{122}$ through $R_{126}$, those listed as R in the formulas I–V may be mentioned. The hydrogen atom, the hydroxy group, the alkyl group, the aryl group, the alkoxy group, the aryl oxy group, and the acyl amino group are preferable to $R_{122}$, $R_{123}$, $R_{125}$, and $R_{126}$ and the alkyl group, the hydroxy group, the aryl group, the alkoxy group, and the aryloxy group are preferable to $R_{124}$. $R_{121}$ and $R_{122}$ may connect with each other to form a 5-member or 6-member cyclic group. In the case, $R_{121}$ and $R_{122}$ may close ring to form a methylenedioxy ring. Still further, $R_{23}$ and $R_{24}$ can connect with each other to form a 5-member hydrocarbon ring and in that case, the alkyl group, the aryl group, or the heterocyclic group is preferable as $R_{21}$.

Specific examples of the compounds represented by formula AO-I are shown below:

Is-1

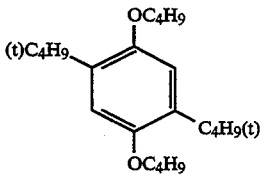

Is-2

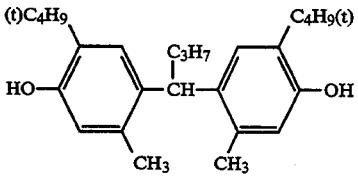

-continued

Is-3

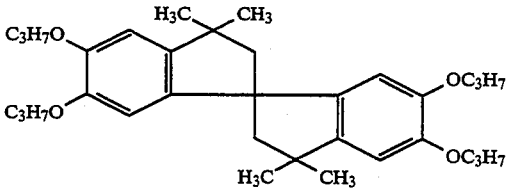

Is-4

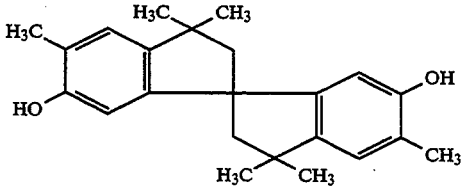

Is-5

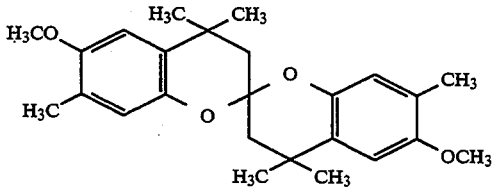

Is-6

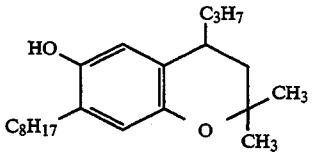

Is-7

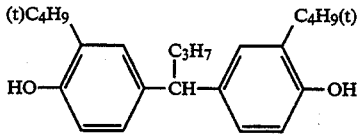

Is-8

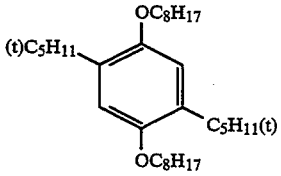

Is-9

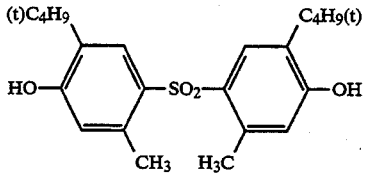

Is-10

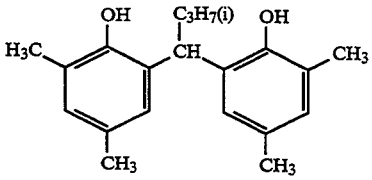

As specific example of compound represented by above-mentioned formula AO-I besides the above-mentioned specific example Exemplified compound A-1 to A-28, described in page 8-page 10 of JA OPI 60-262159, PH-1 to PH-29 described in page 8-page 10 of JA OPI 61-145552 Exemplified compound B-1 to B-21 described in page 6 page 7 of JA OPI 1-306846, Exemplified compound I-1 to I-13, I'-1 to I'-8, II-1 to II-12, II'-1 to II'-21, III-8 to III-14, IV-1 to IV-24, and V-13 to V-17 described in pages 10 to 18 of JA OPI 2-958, Exemplified compound II-1 to II-33 etc. described in pages 10 to 11 of JA OPI 3-39956 can be given.

Next, $R_{131}$ in the above-mentioned formula AO-II, represents an aliphatic group or an aromatic group, preferably an alkyl group or an aryl group or a heterocyclic group, and, most preferably, an aryl group. As for the heterocyclic group which Y forms together with the nitrogen atom, for example, a pyperidine ring, a pyperadine ring, a morpholine ring, a thiomorpholine ring, a thiomorpholine-1, 1-dione ring, pyroridine ring, etc. may be mentioned.

The specific examples of the compounds represented by formula AO-II are given below:

IIs-1

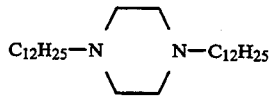

IIs-2

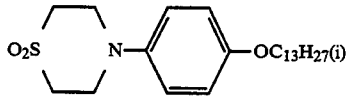

IIs-3

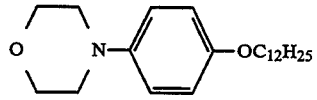

IIs-4

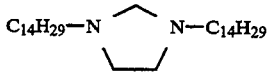

IIs-5

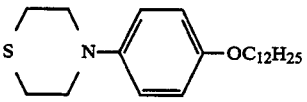

IIs-6

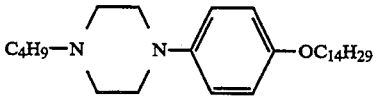

As the specific example of the compound represented by above-mentioned formula AO-II, besides the above-mentioned specific example it is described exemplified compound B-1 through B-65 in pages 8 to 11 of JA OPI 2-167543, and exemplified compounds (1) to (120) etc. in pages 4 to 7 of JA OPI 63-95439.

The added amount of the represented compound of the above-mentioned formula AO-I or AO-II is usually 5 to 500 mol % and, more preferably, 20 to 200 mol % per 100 mol % of the dye-forming coupler of the present invention.

Moreover, in the silver halide emulsion layer which comprises the dye-forming coupler and the polyhydric alcohol of the present invention, a metal chelate compound disclosed in JA O.P.I. 61-158329 and 62-183459, etc. may be incorporated.

EXAMPLES

Next, the present invention is further explained with reference to the following examples.

Example 1

On a paper support, on one side of which polyethylene is laminated and the other side of which polyethylene containing titan ate oxide is laminated, photographic layers, of which compositions are given in Tables 1 and 2, were coated on the side where polyethylene containing titanate oxide is laminated, to prepare a multi-layered silver halide light-sensitive color photographic material, Sample 101. Coating solution was prepared as follows:

To a mixture consisting of 26.7 g of yellow dye-forming coupler(Y-9, a yellow coupler disclosed in page 51 of JA OPI 4-313751), 10.0 g of dye image stabilizer(ST-1),6.6 g of dye image stabilizer(ST-2),0.6 g of anti-staining agent (HQ-1) and 6.67 g of high boiling point organic solvent (DNP), were dissolved by adding 60 ml of ethyl acetate. Then, this mixture was emulsified in 220 ml of 10% gelatin solution using a ultra-sonic homogenizer and thus an emulsion comprising a yellow dye-forming coupler was prepared.

This emulsion was then mixed with a blue-sensitive silver halide emulsion comprising 8.67 of silver by which this dispersant was shown below, anti-irradiation dye (AIY-1) was added, and the coating composition for the first layer was prepared.

As to the second layer through the seventh layer, coating solutions were prepared in the same manner as in the first layer. Moreover, a gelatin hardener (HH-1) was added to the second layer and the fourth layer and (HH-2) was added to the seventh layer. As the coating aid, surfactants (SU-1) and (SU-3) were added to adjust the surface tension of the coating solution.

TABLE 1

| Layer | Composition | Amount added ($g/m^2$) |
|---|---|---|
| 7th layer (Protective layer) | Gelatin | 1.00 |
| 6th layer (UV absorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistaining agent (HQ-1) | 0.01 |
| | DNP | 0.20 |
| | PVP | 0.03 |
| | Anti-irradiation dye (AIC-1) | 0.02 |
| 5th layer (Red-sensitive layer) | Gelatin | 1.30 |
| | Red-sensitive silver chlorobromide emulsion (Em-R) | 0.21 |
| | Cyan coupler (C-3) | 0.24 |
| | Cyan coupler (C-6) | 0.08 |
| | Dye-image stabilizer (ST-1) | 0.20 |
| | Antistaining agent (HQ-1) | 0.01 |
| | HBS-1A | 0.20 |
| | DOP | 0.20 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-1) | 0.03 |
| | DNP | 0.40 |

TABLE 2

| Layer | Composition | Amount added ($g/m^2$) |
|---|---|---|
| 3rd layer (Green-sensitive layer) | Gelatin | 1.40 |
| | Green-sensitive silver chlorobromide emulsion (Em-G) | 0.17 |
| | Magenta coupler (M-29) | 0.75* |
| | DNP | 0.20 |

TABLE 2-continued

| Layer | Composition | Amount added ($g/m^2$) |
|---|---|---|
| | Dye-image stabilizer (Is-8) | 0.75* |
| | Anti-irradiation dye (AIM-1) | 0.01 |
| 2nd layer (Interlayer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Antimold (F-1) | 0.002 |
| 1st layer (Blue-sensitive layer) | Gelatin | 1.20 |
| | Blue-sensitive silver chlorobromide emulsion (Em-B) | 0.26 |
| | Yellow coupler (EY-1) | 0.80 |

TABLE 2-continued

| Layer | Composition | Amount added ($g/m^2$) |
|---|---|---|
| | Dye-image stabilizer (ST-1 | 0.30 |
| | Dye-image stabilizer (ST-2) | 0.20 |
| | Antistaining agent (HQ-1) | 0.02 |
| | Anti-irradiation dye (AIY-1) | 0.01 |
| | DNP | 0.20 |
| Support | Polyethylene-laminated paper sheet | |

*mili-mol/$m^2$

Amounts of the silver halide emulsions added were each shown in terms of the silver contents.

The structural formulae of the compounds used in the respective layers are given below:

Y-9

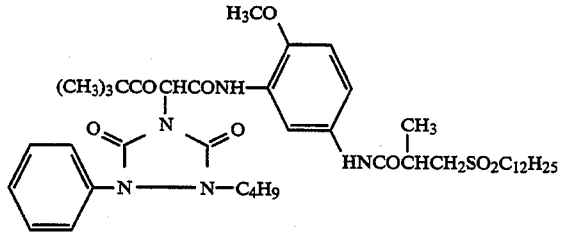

Disclosed in JA OPI 4-313751

C-3

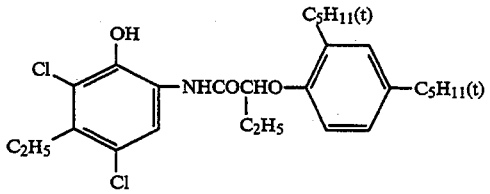

Disclosed in JA OPI 4-313751

C-6

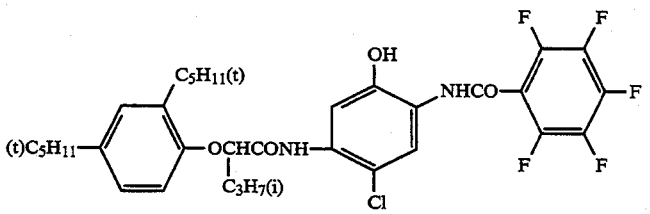

Disclosed in JA OPI 4-313751

M-8

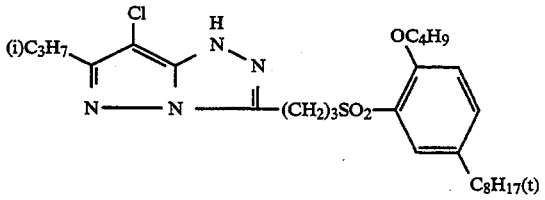

Disclosed in JA OPI 4-313751

ST-1

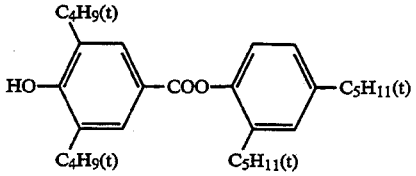

-continued
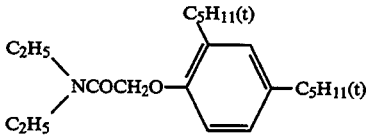
ST-2
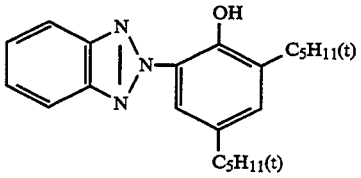
UV-1
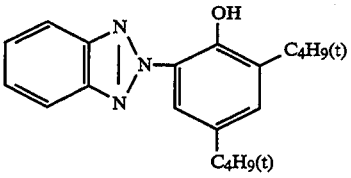
UV-2
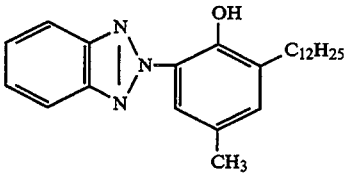
UV-3
DOP: Dioctyl phthalate
;batch Dinonyl phthalate
DIDP: Diisodecyl phthalate
PVP: Polyvinyl pyrrolidone
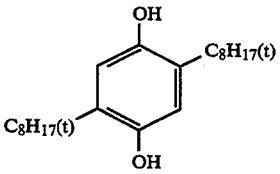
HQ-1
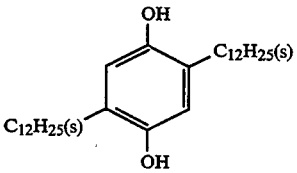
HQ-2
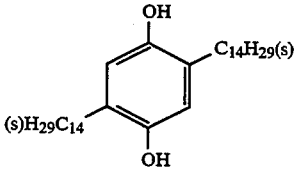
HQ-3
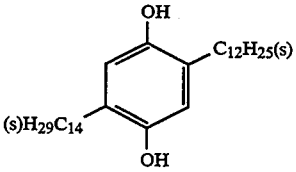
HQ-4

-continued
HQ-5
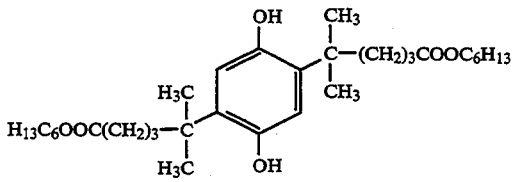
HBS-1A
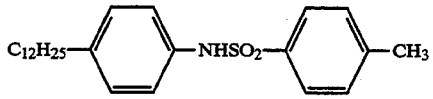
AIM-1
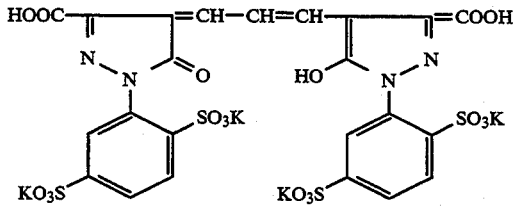
AIC-1
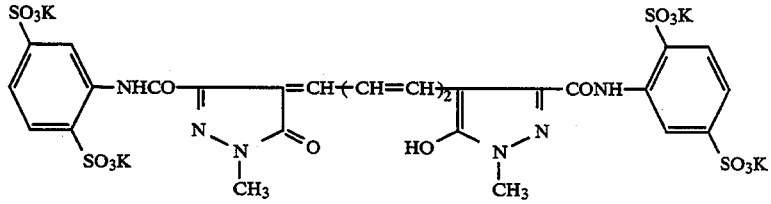
AIY-1
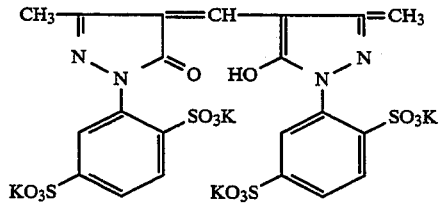
SU-1
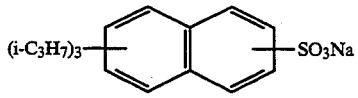
SU-2
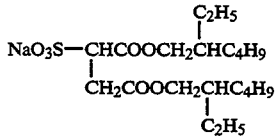
SU-3
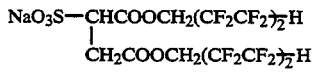
HH-1
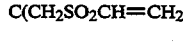
HH-2
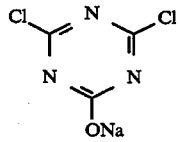
F-1
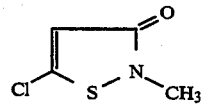
Blue-sensitive silver halide emulsion (Em-B):

| | |
|---|---|
| Sodium thiosulfate | 0.8 mg/mol AgX |
| Chloroauric acid | 0.5 mg/mol AgX |

The structural formula of the compounds used in the respective mono-disperse emulsions containing cubic grains are given below:

BS-1

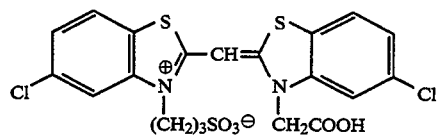

BS-2

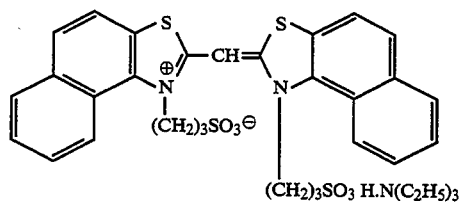

GS-1

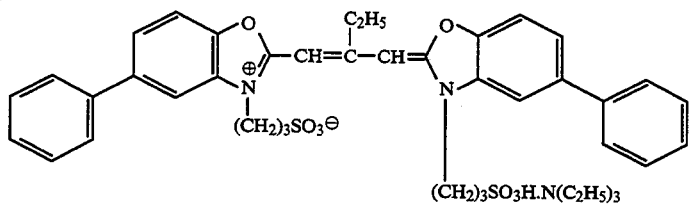

RS-1

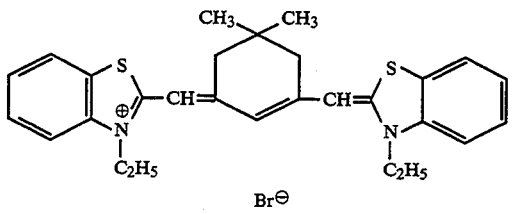

STAB-1

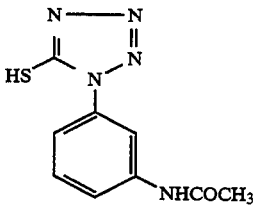

| | |
|---|---|
| Stabilizing agent (STAB-1) | $6 \times 10^{-4}$/mol/AgX |
| Sensitizing dye (BS-1) | $4 \times 10^{-4}$/mol AgX |
| Sensitizing dye (BS-2) | $1 \times 10^{-4}$/mol AgX |

Average grain size 0.43 microns; coefficient of variation=0.08 and silver chloride content 99.5 mol %

| | |
|---|---|
| Sodium thiosulfate | 1.5 mg/mol AgX |
| Chloroauric acid | 1.0 mg/mol AgX |
| Stabilizing agent (STAB-1) | $6 \times 10^{-4}$/mol AgX |
| Sensitizing dye (GS-1) | $4 \times 10^{-4}$/mol AgX |

Red-sensitive silver halide emulsion (Em-R):

Mono-dispersed cubic grain emulsion having average grain size 0.50 micron;, coefficient of variation=0.08 and silver chloride content 99.5 mol %

| | |
|---|---|
| Sodium thiosulfate | 1.8 mg/mol AgX |
| Chloroauric acid | 2.0 mg/mol AgX |
| Stabilizing agent (STAB-1) | $6 \times 10^{-4}$/mol AgX |
| Sensitizing dye (RS-1) | $1 \times 10^{-4}$/mol AgX |

Next, Samples 102 through 120, 105′ to 120′, and 105″ to 105″ were prepared in the same manner as Sample 101 except that the high boiling point organic solvent DNP was replaced by the high boiling point organic solvent or the polyhydric alcohol given in Tables 3, 4 and 5 below:

Thus prepared Samples and Comparative Samples were, after being exposed to green light through an optical wedge in the conventional manner, processed according to the conventional method, of which step, processing temperature and processing time are given below:

| Processing Step | Temperature (°C.) | Time (sec.) |
|---|---|---|
| Color development | 35.0 ± 0.3° C. | 45 |
| Bleach-fixing | 35.0 ± 0.5° C. | 45 |
| Stabilizing | 30 to 34° C. | 90 |
| Drying | 60 to 80° C. | 60 |

The compositions of respective processing solutions are as follows: The replenishing amount of each processing solution is 80 ml per 1m2 of silver halide light-sensitive color photographic material 1 $m^2$.

| Color developer | Tank solution | Replenisher |
|---|---|---|
| Pure water | 800 ml | 800 ml |
| Triethanolamine | 10 g | 18 g |
| N,N-Diethyl hydroxyl amines | 5 g | 9 g |
| Potassium chloride | 2.4 g | |
| 1-hydroxy ethylidene-1,1-di-phosphonic acid | 1.0 g | 1.8 g |
| N-ethyl-N-beta-methane sulfonamide ethyl-4-(aminoaniline)-3-methyl sulfate | 5.4 g | 8.2 g |
| Fluorescent brightening agent 4,4'-di-amino stilbene sulfonate derivative | 1.0 g | 1.8 g |
| Potassium carbonate | 27 g | 27 g |

Add water to make the total volume 1000 ml and in the tank solution, pH is adjusted at 10.10 and pH of the replenisher at 10.60.

Bleach-fixing solution (composition of the replenisher is same as that in the tank.)

| | |
|---|---|
| Ethylene-diamine-tetraacetic acid iron ammonium dehydrate | 60 g |
| Ethylene-diamine-tetraacetic acid | 3 g |
| Ammonium thiosulfate (70% aqueous solution) | 100 ml |
| Ammonium sulfate (40% aqueous solution) | 27.5 ml |

Add water to make the total volume 1000 ml, and pH is adjusted with potassium carbonate or glacial acetic acid at 5.7.

Stabilizing solution (composition of the replenisher is same as that in the tank.).

| | |
|---|---|
| 5-chloro-2-methyl-4-iso-thiazoline-3-on | 1.0 g |
| Ethylene glycol | 1.0 g |
| 1-hydroxyethylidene 1,1-di-phosphonic acid | 2.0 g |
| Ethylene-diamine-tetraacetic acid | 1.0 g |
| Ammonium hydroxide (20% aqueous solution) | 3.0 g |
| Fluorescent whitening agent(4,4'-di-amino stilbene sulfonate derivative) | 1.5 g |

Add water to make the total volume 1000 ml and pH of the solution was adjusted at 7.0 with sulfuric acid or potassium hydroxide.

Samples processed continuously were tested in the following evaluation.

<light stability>

Rate of residual dye density to initial dye density at initial density of 1.0, after irradiation by xenon fade-O-meter for 14 days.

1max;

The maximum absorption wave length of the dye image having reflection density at 1.0 was measured.

Half Peak-value width;

Half peak-value width was measured from spectral absorption spectrogram of the dye image having reflection density at 1.0.

Dmax;

The maximum density of the developed dye image was measured.

Results are shown in Tables 3, 4 and 5.

TABLE 3

| Sample No. | HBS in 3rd layer | Amount of HBS ($g/m^2$) | λmax | Half Peak-value width | Dmax | Residual rate (%) |
|---|---|---|---|---|---|---|
| 101 | DNP | 0.20 | 547 | 110 | 1.97 | 57 |
| 102 | HBS-1 | 0.20 | 561 | 125 | 1.85 | 60 |
| 103 | HBS-2 | 0.20 | 548 | 112 | 2.14 | 58 |
| 104 | HBS-3 | 0.20 | 548 | 120 | 1.41 | 60 |
| 105 | V-1 | 0.20 | 549 | 109 | 2.24 | 65 |
| 106 | V-3 | 0.20 | 547 | 108 | 2.20 | 65 |
| 107 | IV-1 | 0.20 | 549 | 110 | 2.20 | 67 |
| 108 | II-1 | 0.20 | 547 | 108 | 2.22 | 73 |
| 109 | II-5 | 0.20 | 548 | 107 | 2.24 | 71 |
| 110 | II-13 | 0.20 | 547 | 110 | 2.28 | 73 |
| 111 | DNP | 0.60 | 548 | 108 | 1.94 | 62 |
| 112 | HBS-1 | 0.60 | 561 | 122 | 2.27 | 65 |
| 113 | HBS-2 | 0.60 | 549 | 110 | 2.15 | 63 |
| 114 | HBS-3 | 0.60 | 549 | 117 | 1.50 | 64 |
| 115 | V-1 | 0.60 | 548 | 104 | 2.25 | 72 |
| 116 | V-3 | 0.60 | 549 | 105 | 2.20 | 72 |
| 117 | IV-1 | 0.60 | 549 | 106 | 2.20 | 75 |
| 118 | II-1 | 0.60 | 549 | 103 | 2.30 | 82 |
| 119 | II-5 | 0.60 | 547 | 105 | 2.32 | 81 |
| 120 | II-13 | 0.60 | 548 | 105 | 2.34 | 80 |

TABLE 4

| Sample No. | HBS in 3rd layer | Amount of HBS ($g/m^2$) | λmax | Half Peak-value width | Dmax | Residual rate (%) |
|---|---|---|---|---|---|---|
| 101 | DNP | 0.20 | 547 | 110 | 1.97 | 57 |
| 102 | HBS-1 | 0.20 | 561 | 125 | 1.85 | 60 |
| 103 | HBS-2 | 0.20 | 548 | 112 | 2.14 | 58 |
| 104 | HBS-3 | 0.20 | 548 | 120 | 1.41 | 60 |
| 105' | VI-1 | 0.20 | 548 | 110 | 2.24 | 70 |
| 106' | VI-2 | 0.20 | 549 | 107 | 2.20 | 66 |
| 107' | VI-9 | 0.20 | 549 | 109 | 2.20 | 68 |
| 108' | VII-1 | 0.20 | 549 | 109 | 2.22 | 70 |
| 109' | VII-4 | 0.20 | 548 | 106 | 2.24 | 68 |
| 110' | VII-14 | 0.20 | 549 | 110 | 2.28 | 67 |
| 111 | DNP | 0.60 | 548 | 108 | 1.94 | 62 |
| 112 | HBS-1 | 0.60 | 561 | 122 | 2.27 | 65 |
| 113 | HBS-2 | 0.60 | 549 | 110 | 2.15 | 63 |
| 114 | HBS-3 | 0.60 | 549 | 117 | 1.50 | 64 |
| 115' | VI-1 | 0.60 | 548 | 107 | 2.24 | 76 |
| 116' | VI-2 | 0.60 | 548 | 104 | 2.34 | 73 |
| 117' | VI-9 | 0.60 | 549 | 106 | 233 | 73 |
| 118' | VII-1 | 0.60 | 547 | 108 | 2.25 | 77 |
| 119' | VII-4 | 0.60 | 547 | 104 | 2.32 | 74 |
| 120' | VII-14 | 0.60 | 549 | 107 | 2.29 | 74 |

Comparative HBS

HBS-1

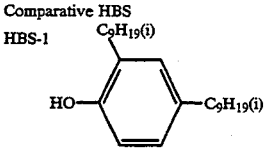

HBS-2 $C_8H_{17}CH{=}CH(CH_2)_8OH$ (High boiling point organic solvent disclosed in EP486,929.)

HBS-3

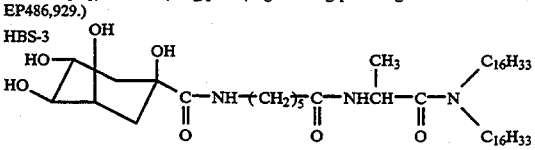

(Disclosed in JA OPI 2-100048)

It is apparent from Tables 3 and 4 that the light stability and the color forming property of the samples according to the present invention (Samples 105 through 110, and 105' through 110'), in which the compound of the present invention is used as a high boiling point organic solvent, have been greatly improved compared with Comparative Sample and the color forming property has also been improved. Moreover, the effect of sharpening of the absorption without changing the maximum absorption wave length was observed. In sample 102 for which HBS-1, which is phenol derivative, is used, some improvement in the light stability was observed, however, the effect was insufficient. In addition, undesirable effects of bathochromic shift and broadening of the absorption were also observed. Sample using a comparative HBS-3 results inferior color developing ability and broader absorption peak though it shows certain improvement of stability against light.

In Samples 111 through 120 and 115′ through 120′ HBS is used in an amount of three times to Samples 101 through 110 and so on. The compound of the present invention works much more effective when large amount thereof is used. The stability against light is improved and sharp absorption peak is obtained.

Example 2

In Example 1 a magenta coupler, HBS and dye stabilizer in the third layer of Sample 101 were replaced with those shown Table 5 to obtain Samples 200 through 214. The same test was conducted as in Example 1. The result is summarized in Table 5.

TABLE 5

| Sample No. | Magenta Coupler in 3rd layer | HBS and amount in 3rd layer ($g/m^2$) | Dye stabilizer and amount thereof ($mmol/m^2$) | Light Stability (Residual rate of dye) |
|---|---|---|---|---|
| 200 | M-8 | DNP (0.20) | Is-9 (0.75)<br>IIs-2 (0.75) | 41 |
| 201 | " | II-5 (0.20) | " | 65 |
| 202 | " | II-5 (0.60) | " | 74 |
| 203 | " | II-26 (0.20) | " | 63 |
| 204 | " | II-26 (0.60) | " | 70 |
| 205 | " | III-1 (0.20) | " | 57 |
| 206 | " | III-1 (0.60) | " | 69 |
| 207 | " | V-5 (0.20) | " | 55 |
| 208 | " | V-5 (0.60) | " | 68 |
| 209 | " | VI-3 (0.20) | " | 61 |
| 210 | " | VI-3 (0.60) | " | 70 |
| 211 | " | VI-7 (0.20) | " | 60 |
| 212 | " | VI-7 (0.60) | " | 68 |
| 213 | " | VII-4 (0.20) | " | 59 |
| 214 | " | VII-4 (0.60) | " | 64 |

Samples using polyhydric alcohol of the invention as a HBS in combination with a magenta coupler M-8 which has a secondary alkyl group at 6th position show the improvement in stability against light. Samples containing increased amount of polyhydric alcohol of the invention (Samples 202, 204, 206, 208, 210, 212, and 214) show further improved stability to light.

Example 3

In Example 1 HBS in the third layer of Sample 101 was replaced with those shown table 6 to obtain Samples 201′ through 212′. The same test was conducted as in Example 1. The result is summarized in Table 6.

TABLE 6

| Sample No. | HBS in 3rd layer, amount thereof ($g/m^2$) | (HBS/Cp)* | Light stability (Dye residual ratio) | Dmax |
|---|---|---|---|---|
| 101 | DNP (0.2) | 0 | 57 | 1.97 |
| 201′ | DNP (0.18)<br>II-1 (0.02) | 0.056 | 58 | 2.17 |
| 202′ | DNP (0.1)<br>II-1 (0.1) | 0.28 | 58 | 2.19 |
| 203′ | DNP (0.02)<br>II-1 (0.18) | 0.51 | 69 | 2.20 |
| 204′ | II-1 (0.2) | 0.56 | 73 | 2.22 |
| 205′ | DNP (0.18)<br>VI-1 (0.02) | 0.056 | 57 | 2.16 |

TABLE 6-continued

| Sample No. | HBS in 3rd layer, amount thereof ($g/m^2$) | (HBS/Cp)* | Light stability (Dye residual ratio) | Dmax |
|---|---|---|---|---|
| 206′ | DNP (0.1)<br>VI-1 (0.1) | 0.28 | 58 | 2.17 |
| 207′ | DNP (0.02)<br>VI-1 (0.18) | 0.51 | 67 | 2.18 |
| 208′ | VI-1 (0.20) | 0.56 | 70 | 2.21 |
| 209′ | DNP (0.18)<br>VII-1 (0.02) | 0.056 | 57 | 2.16 |
| 210′ | DNP (0.1)<br>VII-1 (0.1) | 0.28 | 57 | 2.18 |
| 211′ | DNP (0.02)<br>VII-1 (0.18) | 0.51 | 66 | 2.19 |
| 212′ | VII-1 (0.20) | 0.56 | 70 | 2.20 |

*Weight ratio of polyhydric alcohol to coupler.

In the Example a part of amount of the polyhydric alcohol is replaced with a conventional high boiling solvent. Consequently the weight ratio of the polyhydric alcohol to a coupler is varied. The Table shows that the samples containing a polyhydric alcohol in an amount of more than 50 weight 50% to a coupler are more advantageous in the stability to light. Further samples containing no conventional HBS are much more effective.

Example 4

In Example 1 HBS in the first layer of Sample 101 were replaced with those shown Table 7 to obtain Samples 302 through 311. The resulted samples were exposed wedgewise by blue light, and same developing process and test was conducted as in Example 1. The result is summarized in Table 7.

TABLE 7

| Sample No. | HBS in 1st layer | Amount of HBS ($g/m^2$) | Dmax | Light stability (Dye residual ratio) |
|---|---|---|---|---|
| 301 | DNP | 0.20 | 2.58 | 81 |
| 302 | HBS-2 | 0.20 | 2.27 | 75 |
| 303 | II-2 | 0.20 | 2.49 | 88 |
| 304 | III-9 | 0.20 | 2.47 | 86 |
| 305 | IV-9 | 0.20 | 2.47 | 85 |
| 306 | V-14 | 0.20 | 2.42 | 85 |
| 307 | VI-4 | 0.20 | 2.45 | 84 |
| 308 | VI-8 | 0.20 | 2.48 | 84 |
| 309 | VII-3 | 0.20 | 2.41 | 86 |
| 310 | VII-6 | 0.20 | 2.44 | 85 |
| 311 | VII-7 | 0.20 | 2.39 | 86 |

Table 7 shows that the samples containing the polyhydric alcohol compound of the invention (Samples 303 through 311) exhibit improved stability to light and color developabilty. HBS-2, that has one hydroxy group in the molecule, exhibits improvement of stability to light slightly, but deterioration of color developability.

Example 5

In Example 1 HBS in the fifth layer of Sample 101 were replaced with those shown Table 8 to obtain Samples 402 through 411. The resulted samples were exposed wedgewise by red light, and same developing process and test was conducted as in Example 1. The result is summarized in Table 8.

TABLE 8

| Sample No. | HBS in 5th layer | Amount of HBS ($g/m^2$) | Dmax | Light stability (Dye residual ratio) |
|---|---|---|---|---|
| 401 | DOP | 0.20 | 2.07 | 70 |
| 402 | HBS-2 | 0.20 | 2.05 | 72 |

TABLE 8-continued

| Sample No. | HBS in 5th layer | Amount of HBS (g/m²) | Dmax | Light stability (Dye residual ratio) |
|---|---|---|---|---|
| 403 | II-2 | 0.20 | 2.24 | 82 |
| 404 | III-9 | 0.20 | 2.20 | 82 |
| 405 | IV-9 | 0.20 | 2.20 | 79 |
| 406 | V-14 | 0.20 | 2.17 | 78 |
| 407 | VI-4 | 0.20 | 2.19 | 80 |
| 408 | VI-8 | 0.20 | 2.25 | 83 |
| 409 | VII-3 | 0.20 | 2.25 | 81 |
| 410 | VII-6 | 0.20 | 2.19 | 82 |
| 411 | VII-7 | 0.20 | 2.30 | 77 |

Table 8 shows that the samples containing the polyhydric alcohol compound of the invention (Samples 403 through 411) exhibit improved stability to light and color developabilty. HBS-2, that has one hydroxy group in the molecule, exhibits improvement of stability to light slightly, but deterioration of color developability.

We claim:

1. A silver halide color photographic light-sensitive material comprising a silver halide emulsion layer provided on a support, wherein the silver halide emulsion layer contains a polyvalent alcohol represented by Formulas II through VII;

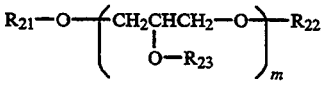

II wherein $R_{21}$, $R_{22}$ and $R_{23}$ each represent a hydrogen atom, alkyl, alkenyl, cycloalkyl, cycloalkenyl, acyl, sulfonyl, phosphonyl, carbamoyl or sulfamoyl group, m is an integer of 1 to 20, when m is two or more, two or more of $R_{23}$ may be same or different, when m is 1, two of $R_{21}$, $R_{22}$ and $R_{23}$ are hydrogen atom, when m is two or more, at least two of $R_{21}$, $R_{22}$ and $R_{23}$ are hydrogen atom but all of $R_{21}$, $R_{22}$ and $R_{23}$ are not a hydrogen atom simultaneously;

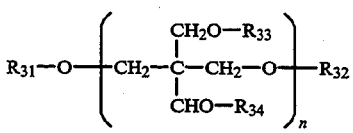

III wherein $R_{31}$, $R_{32}$, $R_{33}$ and $R_{34}$ each represent a hydrogen atom, an alkyl, alkenyl, cycloalkyl, cycloalkenyl, acyl, sulfonyl, phosphonyl, carbamoyl or sulfamoyl group, n is an integer of 1 to 20, when 2 is two or more, two or more of $R_{33}$ or $R_{34}$ may be same or different, when n is 1, at least two of more, at least two of $R_{31}$, $R_{32}$, $R_{33}$ and $R_{34}$ are hydrogen atom $R_{31}$, $R_{32}$, $R_{33}$ and $R_{34}$ are hydrogen atom, when n is two or but all of $R_{31}$, $R_{32}$, $R_{33}$ and $R_{34}$ are not a hydrogen atom simultaneously;

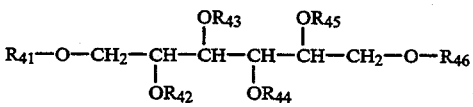

IV wherein $R_{41}$ to $R_{46}$ each represent a hydrogen atom, an alkyl, alkenyl, cycloalkyl, cycloalkenyl, acyl, sulfonyl, phosphonyl, carbamoyl or sulfamoyl group, and at least two of $R_{41}$, $R_{42}$, $R_{43}$, $R_{44}$, $R_{45}$ and $R_{46}$ are hydrogen atom but all of $R_{41}$ to $R_{46}$ are not a hydrogen atom simultaneously;

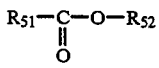

V wherein $R_{51}$ is a substituted alkyl or substituted alkenyl group each of which has two or more hydroxy groups, $R_{52}$ is an alkyl, alkenyl, cycloalkyl or cycloalkenyl group, and $R_{51}$ and $R_{52}$ may form a lacton ring by condensation each other;

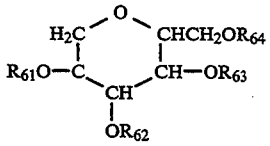

VI

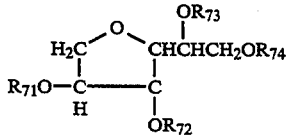

VII wherein, $R_{61}$ $R_{62}$, $R_{63}$, $R_{64}$, $R_{71}$, $R_{72}$, $R_{73}$ and $R_{74}$ each represent a hydrogen atom, an alkyl, alkenyl, cycloalkyl, cycloalkenyl, aryl, acyl, sulfonyl, phosphonyl, carbamoyl or sulfamoyl group, and at least two of $R_{61}$, $R_{62}$, $R_{63}$, $R_{64}$, $R_{71}$, $R_{72}$, $R_{73}$ and $R_{74}$ are hydrogen atom but all of $R_{61}$ to $R_{64}$ and $R_{71}$ to $R_{74}$ are not a hydrogen atom simultaneously.

2. A silver halide color photographic light-sensitive material of claim 1, wherein the polyvalent alcohol is represented by the Formula II, VI or VII;

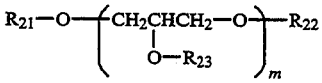

II wherein $R_{21}$, $R_{22}$ and $R_{23}$ each represent a hydrogen atom, alkyl, alkenyl, cycloalkyl, cycloalkenyl, acyl, sulfonyl, phosphonyl, carbamoyl or sulfamoyl group, m is an integer of 1 to 20, when m is two or more, two or more of $R_{23}$ may be same or different, when m is 1, two of $R_{21}$, $R_{22}$ and $R_{23}$ are hydrogen atom, when m is two or more, at least two of $R_{21}$, $R_{22}$ and $R_{23}$ are hydrogen atom but all of $R_{21}$, $R_{22}$ and $R_{23}$ are not a hydrogen atom simultaneously;

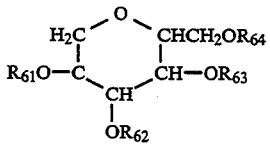

VI

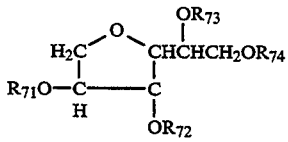

VII wherein, $R_{61}$ $R_{62}$, $R_{63}$, $R_{64}$, $R_{71}$, $R_{72}$, $R_{73}$ and $R_{74}$ each represent a hydrogen atom, an alkyl, alkenyl, cycloalkyl, cycloalkenyl, aryl, acyl, sulfonyl, phosphonyl, carbamoyl or sulfamoyl group, and at least two of $R_{61}$, $R_{62}$, $R_{63}$ and $R_{64}$ are hydrogen atom but all of $R_{61}$ to $R_{64}$ are not a hydrogen atom simultaneously, and at least two of $R_{71}$, $R_{72}$, $R_{73}$ and $R_{74}$ are hydrogen atom but all of $R_{71}$ to $R_{74}$ are not a hydrogen atom simultaneously.

3. A silver halide color photographic light-sensitive material of claim 2, wherein total number of carbons in the polyvalent alcohol is not less than 6 for a compound of Formula II and not less than 10 for a compound of Formulas VI and VII.

4. A silver halide color photographic light-sensitive material of claim 2, wherein the polyvalent alcohol is represented by the Formula II, VI or VII;

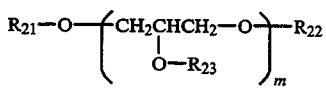

II wherein $R_{21}$, $R_{22}$ and $R_{23}$ each represent a hydrogen atom or an acyl group, m is an integer of 1 to 3, when m is two or more, two or more of $R_{23}$ may be same or different, when m is 1, two of $R_{21}$, $R_{22}$ and $R_{23}$ are hydrogen atom, when m is two or more, at least two of $R_{21}$, $R_{22}$ and $R_{23}$ are hydrogen atom but all of $R_{21}$, $R_{22}$ and $R_{23}$ are not a hydrogen atom simultaneously;

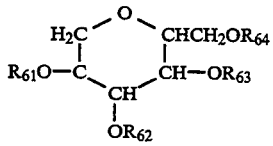

VI

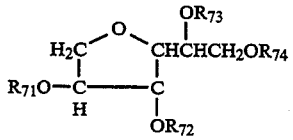

VII wherein, $R_{61}$ $R_{62}$, $R_{63}$, $R_{64}$, $R_{71}$, $R_{72}$, $R_{73}$ and $R_{74}$ each represent a hydrogen atom, an acyl group, and at least two of $R_{61}$, $R_{62}$, $R_{63}$ and $R_{64}$ are hydrogen atom but all of $R_{61}$ to $R_{64}$ are not a hydrogen atom simultaneously, and at least two of $R_{71}$, $R_{72}$, $R_{73}$ and $R_{74}$ are hydrogen atom but all of $R_{71}$ to $R_{74}$ are not a hydrogen atom simultaneously.

5. A silver halide color photographic light-sensitive material of claim 2, wherein the polyvalent alcohol is represented by the Formula II;

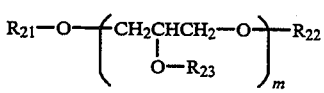

II wherein $R_{21}$, $R_{22}$ and $R_{23}$ each represent a hydrogen atom, alkyl, alkenyl, cycloalkyl, cycloalkenyl, acyl, sulfonyl, phosphonyl, carbamoyl or sulfamoyl group, m is an integer of 1 to 3, when m is two or more, two or more of $R_{23}$ may be same hydrogen atom, when m is two or more, at least two of $R_{21}$, $R_{22}$ and $R_{23}$ are hydrogen atom but all of $R_{21}$, $R_{22}$ and $R_{23}$ are not a hydrogen atom simultaneously.

6. A silver halide color photographic light-sensitive material of claim 5, wherein $R_{21}$, $R_{22}$ and $R_{23}$ each represent a hydrogen atom or an acyl group, m is an integer of 1 to 3, when m is two or more, two or more of $R_{23}$ may be same or different, when m is 1, two of $R_{21}$, $R_{22}$ and $R_{23}$ are hydrogen atom, when m is two or more, at least two of $R_{21}$, $R_{22}$ and $R_{23}$ are hydrogen atom but all of $R_{21}$, $R_{22}$ and $R_{23}$ are not a hydrogen atom simultaneously.

7. A silver halide color photographic light-sensitive material of claim 1, wherein the silver halide emulsion layer contains a dye forming coupler and the polyvalent alcohol represented by Formulas II through VII, and the polyvalent alcohol is contained in a lipophilic fine grain containing the dye forming coupler.

8. A silver halide color photographic light-sensitive material of claim 7, wherein the polyvalent alcohol represented by Formulas II through VII is contained in a lipophilic fine grain containing the dye forming coupler at the ratio by weight of not less than 50% to the dye forming coupler.

9. A silver halide color photographic light-sensitive material of claim 7, wherein the dye forming coupler is a yellow coupler, a magenta coupler or a cyan coupler.

10. A silver halide color photographic light-sensitive material of claim 9, wherein the dye forming coupler is a magenta coupler.

11. A silver halide color photographic light-sensitive material of claim 1, wherein molecular weight of the polyvalent alcohol is not more than 5,000.

12. A silver halide color photographic light-sensitive material of claim 1, wherein the polyvalent alcohol is in the state of liquid at room temperature.

13. A silver halide color photographic light-sensitive material comprising a support and a silver halide emulsion layer provided thereon containing a lipophilic fine grain comprising a dye forming coupler and a polyvalent alcohol represented by Formula II at the ratio of the polyvalent alcohol being not less than 50% to the dye forming coupler by weight

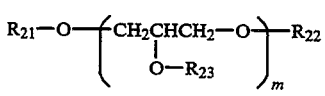

II wherein $R_{21}$, $R_{22}$ and $R_{23}$ each represent a hydrogen atom or an acyl group, m is an integer of 1 to 3, when m is 2 or 3, two or more of $R_{23}$ may be same or different, when m is 1, two of $R_{21}$, $R_{22}$ and $R_{23}$ are hydrogen atom, when m is 2 or 3, at least two of $R_{21}$, $R_{22}$ and $R_{23}$ are hydrogen atom but all of $R_{21}$, $R_{22}$ and $R_{23}$ are not a hydrogen atom simultaneously.

* * * * *